US006619083B2

(12) United States Patent
Hartel et al.

(10) Patent No.: US 6,619,083 B2
(45) **Date of Patent: *Sep. 16, 2003**

(54) LOCKING ARRANGEMENT

(75) Inventors: Marc Hartel, Reiskirchen (DE); Andreas Wiesemann, Wetter (DE)

(73) Assignee: Rittel GmbH & Co. KG, Herborn (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/971,106

(22) Filed: Oct. 4, 2001

(65) Prior Publication Data

US 2002/0083745 A1 Jul. 4, 2002

(30) Foreign Application Priority Data

Oct. 5, 2000 (DE) ..... 100 49 638

(51) Int. Cl.[7] ..... E05B 13/00
(52) U.S. Cl. ..... 70/208; 70/213; 70/284; 70/285; 70/DIG. 63
(58) Field of Search ..... 70/208, 213, 284, 70/285, DIG. 63, 78, 219; 292/336.3, DIG. 31

(56) References Cited

U.S. PATENT DOCUMENTS

| | | | | | |
|---|---|---|---|---|---|
| 1,431,263 | A | * | 10/1922 | Shannon | |
| 1,613,550 | A | * | 1/1927 | Wildrick | |
| 3,107,513 | A | * | 10/1963 | Walston | |
| 3,633,388 | A | * | 1/1972 | Atkinson | 70/80 |
| 3,745,796 | A | * | 7/1973 | Fleming | 70/81 |
| 4,134,281 | A | * | 1/1979 | Pelcin | 70/208 |
| 5,063,764 | A | * | 11/1991 | Amis et al. | 70/100 |
| 5,345,798 | A | * | 9/1994 | Nakai | 70/284 |
| 5,347,834 | A | * | 9/1994 | Ramsauer | 70/120 |
| 5,692,403 | A | * | 12/1997 | Ling | 70/312 |
| 6,363,761 | B1 | * | 4/2002 | Sauerland | 70/208 |

FOREIGN PATENT DOCUMENTS

| | | | | |
|---|---|---|---|---|
| DE | 198 01 721 | | 4/1999 | |
| EP | 0 155 543 | | 7/1991 | |
| FR | 810381 | * | 3/1937 | 70/285 |
| FR | 1482991 | * | 4/1967 | 70/284 |
| FR | 2641952 | * | 7/1990 | 70/285 |
| JP | 403030088 | * | 2/1991 | 70/208 |
| JP | 404016682 | * | 1/1992 | 70/285 |

* cited by examiner

*Primary Examiner*—Lloyd A. Gall
(74) *Attorney, Agent, or Firm*—Pauley Petersen Kinne & Erickson

(57) ABSTRACT

A locking arrangement for a switchgear cabinet, having a holding device, which contains a manual lever in a handle receptacle, wherein the manual lever can be arrested in a locked position on the holding device by means of a displaceably seated bolt. For actuating the bolt, the holding device, which is in operative contact with the bolt, contains a lock in a lock housing. In order to make such a locking arrangement accessible to a limited and definite group of people with little cost, wherein a conversion of the lock at a later time remains possible, the lock, a secondary lock, is designed as a number lock with adjustable number wheels. The secondary lock is inserted into a lock receptacle in the lock housing and is interchangeably fastened from the inside of the lock housing in fastening receivers, and the secondary lock has a control member acting on but is not connected with an actuating shoulder of the actuating member.

14 Claims, 2 Drawing Sheets

LOCKING ARRANGEMENT

BACKGROUND OF THE INVENTION

1. Field of the Invention

This invention relates to a locking arrangement for a switchgear cabinet, having a holding device, which contains a manual lever in a handle receptacle, wherein the manual lever can be arrested in a locked position on the holding device by a displaceably seated bolt and for actuating the bolt, the holding device, which is in operative contact with the bolt, contains a lock in a lock housing.

2. Description of Related Art

A locking arrangement of this type is known from German Patent Reference DE 198 01 721 C1. The manual lever of this locking arrangement is pivotally fastened in a holding device. Here, the manual lever can be pivoted in a plane extending perpendicular with respect to the cabinet door to which the holding device is attached. In the initial position the manual lever is maintained in a lever receptacle. A bolt prevents the manual lever from being inadvertently moved into the open position. The bolt can be disengaged by a slide. The slide is actuated by a lock, for example a profiled semi-cylinder. As soon as the manual lever is disengaged, it can be grasped and pivoted into its open position.

A similar arrangement is also known from European Patent Reference EP 0 155 543 B1. There, the manual lever is also securely fixed in a handle receptacle. As soon as it is disengaged, it is snapped into an actuating position through the action of a spring element. It can be grasped there and pivoted around an axis of rotation extending perpendicular with respect to the cabinet door.

SUMMARY OF THE INVENTION

One object of this invention is to provide a locking arrangement of the type mentioned above but which allows an arbitrary, but definitely selected group of people access to a switchgear cabinet, and wherein a later change of the lock system is easily possible.

This object is achieved with a lock, hereinafter called secondary lock, designed as a number lock with adjustable number wheels. The secondary lock is inserted into a lock receptacle in the lock housing and is interchangeably fastened from the inside of the lock housing in fastening receivers. The secondary lock has a control member acting on an actuating shoulder of the actuating member, but is not connected.

The number lock has coding, which initially is only known to the owner of the switchgear cabinet. The owner can make the code numbers available to a desired group of people, for example operators and maintenance personnel. If a change of the lock becomes necessary after a time, for example because the requirements for use change, the secondary lock can be removed without problems. The cost required for this is rather small, because the secondary lock merely needs to be removed from the fastening receivers.

In accordance with one preferred embodiment of this invention, the secondary lock has a rotary slide which supports the control member arranged in the interior of the lock housing. The rotary slide is not blocked when the code is set at the number wheels, but is blocked at other times. The secondary lock has a decoding device, which can be actuated when the number code is set, and a new number code can be set on the number wheels when the decoding device is actuated.

Thus the owner of the switchgear cabinet can change the coding when the group of users changes.

Possible unauthorized operation of the secondary lock are limited, if the lock receptacle for the lock housing widens toward the exterior surface of the lock in the form of a shoulder, and the shoulder receives a flange of the secondary lock flush with the surface.

In one embodiment of this invention, the secondary lock has a resting surface facing the interior of the lock housing, which is supported on a support element of the lock housing. The fastening receiver is embodied as at least one screw receiver formed in one piece on the lock housing. Fastening screws are inserted into the fastening receiver and screwed into the secondary lock. The fastening screws maintain the contact surface clamped to the support element. A secure fixation of the secondary lock is thus achieved, which can also simply be reversed when required.

A locking arrangement in accordance with this invention can be designed so that in place of the secondary lock a cover is fastened on the inside of the lock housing. The cover then masks the lock receptacle. In this way the locking arrangement can be adapted to the requirements of the user. If no use of a secondary lock is intended, the cover is inserted. It then can no longer be removed from the outside, because it is fixed in place on the inside of the lock housing.

The ability to exchange the secondary lock is possible in a particularly simple manner if the actuating member has a push rod, which is displaceably seated in the lock housing. The push rod has an actuating shoulder projecting in the direction of the secondary lock. The actuating shoulder has a control cam, on which the control member of the secondary lock runs up when the actuating member is operated. Thus there is no fixed mechanical association between the fastening shoulder and the control member, which would have to be released in the event of an exchange.

In accordance with a preferred embodiment of this invention, the lock housing receives a lock in addition to the secondary lock, which is also in operative contact with the bolt. With the lock mechanism thus created, it is possible to operate the bolt with two locks, which operate independently of each other. Two different groups of authorized users can thus be defined, each of which then has access to the locking arrangement.

The ability to exchange the secondary lock becomes possible in a simple way if the lock has a control member which is in loose engagement with an actuating shoulder of the control member for operating the bolt.

BRIEF DESCRIPTION OF THE DRAWINGS

This invention is explained in greater detail in view of exemplary embodiments shown in the drawings, wherein.

DESCRIPTION OF PREFERRED EMBODIMENTS

Figure 1:
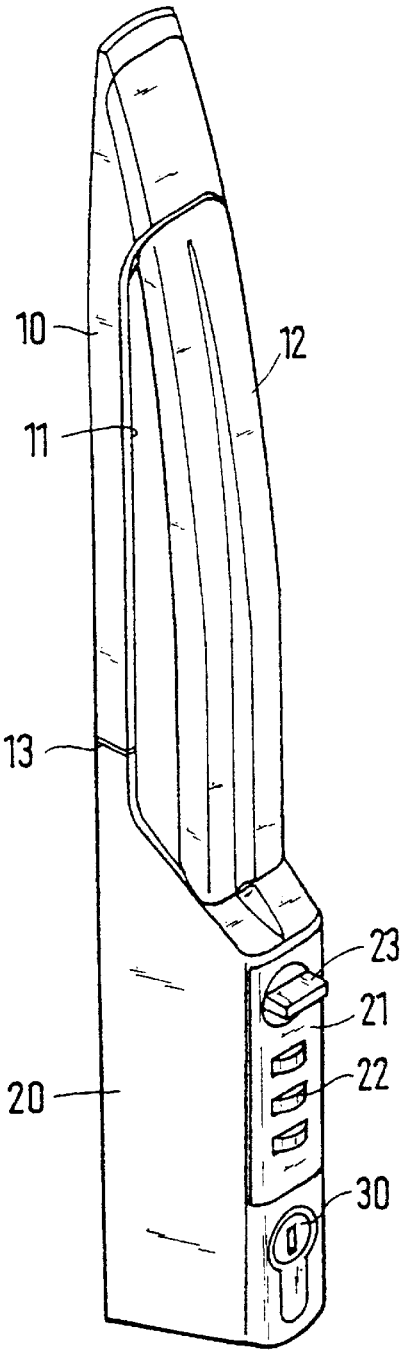
FIG. 1 is a perspective lateral view of a locking arrangement for a switchgear cabinet.

A locking arrangement with a holding device 10 and a lock housing 20 is shown in FIG. 1. The holding device 10 has a mechanical interface 13, on which the lock housing 20 can be installed. Together with the lock housing 20, the holding device 10 forms a handle receptacle 11. A manual lever 12 is arranged therein in its locked position.

The lock housing 20 has a lock 30 and a secondary lock 21, which are arranged on top of each other. The secondary lock 21 is designed as a number lock and has three adjustable number wheels 22. The secondary lock 21 also has a rotary slide 23, which can be grasped by the handle on its front and rotated.

Figure 2:
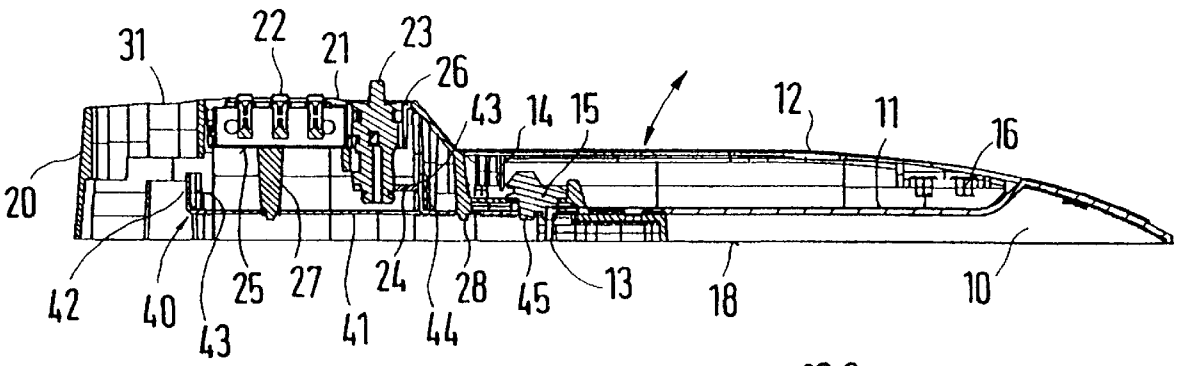
FIG. 2 shows the locking arrangement of FIG. 1, in vertical section.
Figure 3:
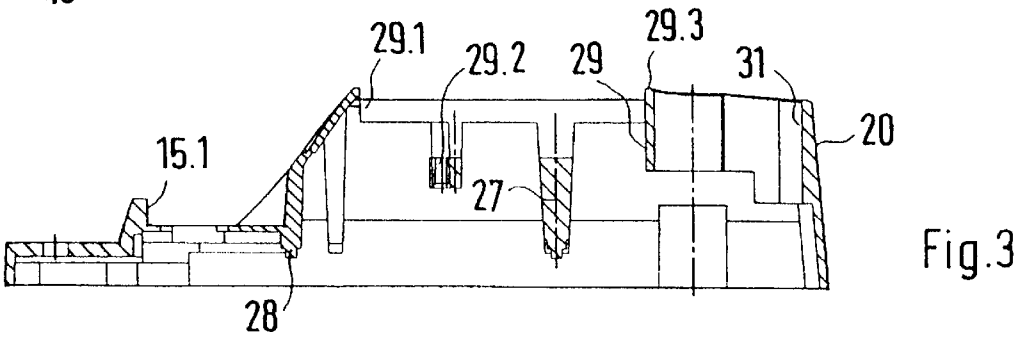
FIG. 3 shows a lock housing of the locking arrangement of FIGS. 1 and 2, in a lateral sectional view.

As shown in FIG. 2, the locking arrangement has a contact surface 18 with which it can be placed on the front of a switchgear cabinet door. In the installed state, the manual lever 12 is pivotally seated in a plane vertically with respect to the door plane. In the closed position shown in FIG. 2, the manual lever 12 is held in place in the handle receptacle 11 with a bolt 15. Thus, the bolt 15 extends behind a tumbler 14 of the manual lever 12. The bolt 15 is displaceably seated on the lock housing 20. An actuating member 40 is installed on the bolt 15. The actuating member 40 has a push rod 41, which is maintained on a support element 27 and a sliding bearing 28 of the lock housing 20, as shown in FIG. 3. The actuating member 40 can be displaced linearly and parallel with respect to the drawing plane. It is cut from a sheet steel blank in the form of a stamped and bent element. Actuating shoulders 42 are bent off the push rod 41. The actuating shoulders 42 project into an interior surrounded by the lock housing 20.

FIGS. 2 and 3, for reasons of clarity. The secondary lock 21 is also inserted into a lock receptacle 29 of the lock housing 20. Together with the components supporting the number wheels 22 and the rotary slide 23 it forms an assembly. It can be handled as a unit and can be inserted into the corresponding lock receptacle 29. In the installed state, the secondary lock 21 is supported by its circumferential flange 26 in a recessed receiver in the lock housing 20. On the top, the flange 26 terminates flush with the visible face 29.3 of the lock housing 20. In accordance with one embodiment of this invention, the lock receptacle 29 for the lock housing 20 widens toward an exterior surface of the lock in the form of a shoulder 29.1, and the shoulder 29.1 receives the flange 26 of the secondary lock 21 flush with the surface. Thus the insertion of a tool behind the flange and unauthorized operations performed on the locking arrangement are prevented. The secondary lock 21 has a resting surface 25, which faces the interior of the lock housing 20 and is supported on the support element 27. The secondary lock 21 can be fixed in place from the direction of the lock housing inside with fastening screws which are screwed into fastening receivers 29.2 of the lock housing 20.

The rotary slide 23 has a control member 24 which is in operative contact with the actuating shoulder 44 of the push rod 41. The second actuating shoulder 42 is in operative contact with a control member 24 of the lock, not shown in FIG. 2. For improved operability, the actuating shoulders 42 and 44 have lateral control cams 43 on which control member 24 can run up when the lock is operated.

Either the lock 30 or the secondary lock 21 can be used for unlocking the manual lever 12. To operate the secondary lock 21, it is first necessary to set a code on the number wheels 22. The secondary lock 21 has a decoding device, which can be actuated when the code is set, and a new code can be set on the number wheels when the decoding device is actuated. Thereafter, the rotary slide 23 can be rotated on an axis vertically with respect to the contact surface 18. In the process, the control member 24 slides up on the control cam 43 of the actuating shoulder 44. Thus the actuating member 40 is displaced toward the right in the drawing plane of FIG. 2. The displacement movement is performed against a spring, which holds the actuating member 40 under spring prestress. As soon as the bolt 15 releases the tumbler 14, the manual lever 12 is pivoted around the handle seat 16 out of the handle receptacle 11. The pivoting-out movement is assisted by a spring.

In place of operating the actuating member 40 by means of the secondary lock 21, an operation of the bolt 15 can also be performed by the lock 30. The lock 30 also has a control member 24, not shown in FIG. 2, which slides up on the control cam 43 of the actuating shoulder 42.

Figure 4:
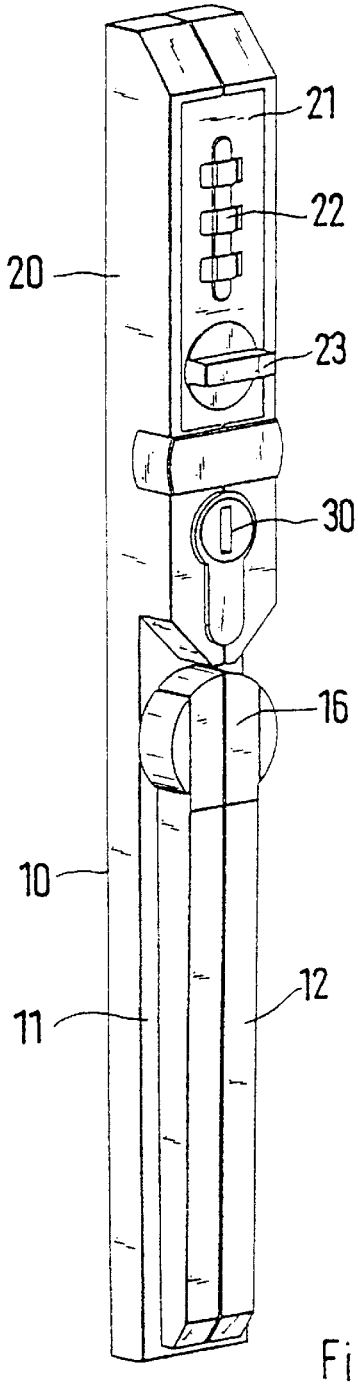
FIG. 4 shows a further embodiment of a locking arrangement for a switchgear cabinet.
Figure 5:
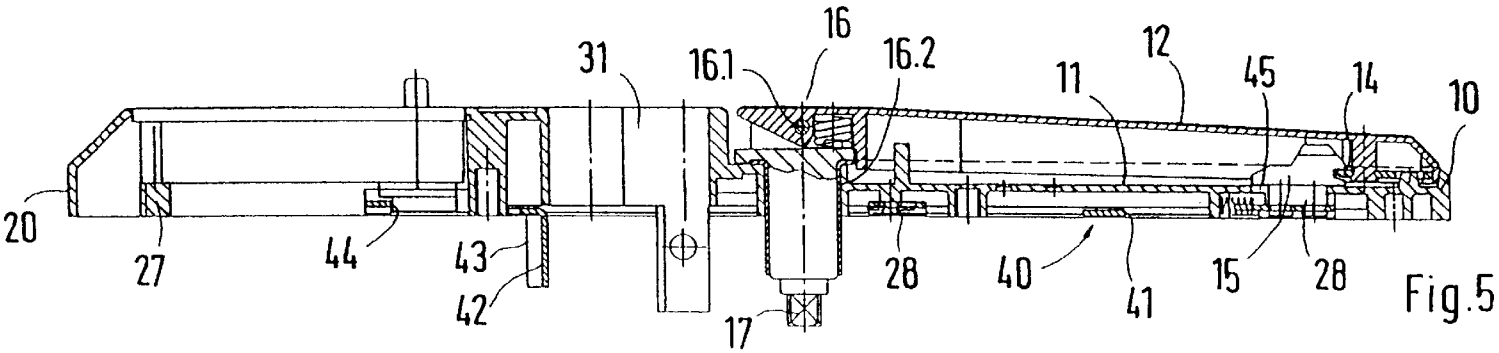
FIG. 5 shows the locking arrangement of FIG. 4, in vertical section.

A further embodiment variation of a locking arrangement is shown in FIGS. 4 and 5. It is functionally constructed similar to the locking arrangements in accordance with FIGS. 1 and 2. In its locked position, the manual lever 12 is fixed in place in a handle receptacle 11 by means of a bolt 15, which is shown in FIG. 5. The actuating member 40, which is embodied in the shape of a frame, is coupled to the bolt 15. In the same way as with the locking arrangement shown in FIGS. 1 and 2, the actuating member 40 can again be triggered by means of two actuating shoulders 42, 44 selectively by a lock 30 or a secondary lock 21. When the bolt 15 is released, the manual lever 12 is pivoted out in a plane vertically with respect to the switchgear cabinet door. In this case the pivot movement takes place around the pivot bearing, identified by 16.1 in FIG. 5. In the pivoted-out state the manual lever 12 can be grasped and pivoted around a rotary bearing 16.2.

Here, the pivot axis of the rotary bearing 16.2 extends vertically with respect to the plane of the cabinet door. During rotation of the manual lever 12, a bearing journal 17 rotates inside the rotary bearing 16.2. A locking rod system of the cabinet door can be moved by the rotation of the bearing journal 17.

What is claimed is:

1. In a locking arrangement for a switchgear cabinet, having a holding device, which contains a manual lever in a handle receptacle, wherein the manual lever is arrested in a locked position on the holding device by a displaceably seated bolt wherein for actuating the bolt the holding device which is in operative contact with the bolt contains more than one lock in a lock housing, the improvement comprising:

a lock (30) inserted into a lock receptacle (31) in the lock housing (20) in operative contact with the bolt (15);

a secondary lock (21) designed as a number lock with adjustable number wheels (22);

the secondary lock (21) inserted into a lock receptacle (29) in the lock housing (20) and interchangeably fastened from an interior of the lock housing (20) in fastening receivers (29.2); and the secondary lock (21) having a control member (24) acting on but unconnected from an actuating shoulder (44) of an actuating member (40).

2. In the locking arrangement in accordance with claim 1, wherein the secondary lock (21) has a rotary slide (23) which supports the control member (24) arranged in the interior of the lock housing (20), the rotary slide (23) is unblocked when a code is set at the number wheels (22) but is blocked at other times.

3. In the locking arrangement in accordance with claim 2, wherein the secondary lock (21) has a decoding device which can be actuated when the code is set, and a new number code is set on the number wheels (22) when the decoding device is actuated.

4. In the locking arrangement in accordance with claim 3, wherein the lock receptacle (29) for the lock housing (20) widens toward an exterior surface (29.3) of the lock in a form of a shoulder (29.1), and the shoulder (29.1) receives a flange (26) of the secondary lock (21) flush with the surface.

5. In the locking arrangement in accordance with claim 4, wherein the secondary lock (21) has a resting surface (25) facing the interior of the lock housing (20) which is supported on a support element (27) of the lock housing (20), the fastening receivers (29.2) are formed as at least one screw receiver in one piece on the lock housing (20), fastening screws are inserted into the fastening receiver (29.2) and screwed into the secondary lock (21), and the fastening screws maintain the resting surface (25) clamped to the support element (27).

6. In the locking arrangement in accordance with claim 5, wherein the secondary lock (21) is removable from the lock housing (20) and exchangeable with a cover fastened on an inside of the lock housing (20), and the cover masks the lock receptacle (29).

7. In the locking arrangement in accordance with claim 6, wherein the actuating member (40) has a push rod (41) displaceably seated in the lock housing (20), the push rod (41) has an actuating shoulder (44) projecting in a direction of the secondary lock (21), and the actuating shoulder (44) has a control cam (43) on which the control member (24) of the secondary lock (21) runs up when the actuating member (40) is operated.

8. In the locking arrangement in accordance with claim 7, wherein the lock (30) has a control member in loose engagement with an actuating shoulder (42) of the actuating member (40) for operating the bolt (15).

9. In the locking arrangement in accordance with claim 1, wherein the secondary lock (21) has a decoding device which can be actuated when a code is set, and a new number code is set on the number wheels (22) when the decoding device is actuated.

10. In the locking arrangement in accordance with claim 1, wherein the lock receptacle (29) for the lock housing (20) widens toward an exterior surface (29.3) of the lock in a form of a shoulder (29.1), and the shoulder (29.1) receives a flange (26) of the secondary lock (21) flush with the surface.

11. In the locking arrangement in accordance with claim 1, wherein the secondary lock (21) has a resting surface (25) facing the interior of the lock housing (20) which is supported on a support element (27) of the lock housing (20), the fastening receivers (29.2) are formed as at least one screw receiver in one piece on the lock housing (20), fastening screws are inserted into the fastening receiver (29.2) and screwed into the secondary lock (21), and the fastening screws maintain the resting surface (25) clamped to the support element (27).

12. In the locking arrangement in accordance with claim 1, wherein the secondary lock (21) is removable from the lock housing (20) and exchangeable with a cover fastened on an inside of the lock housing (20), and the cover masks the lock receptacle (29).

13. In the locking arrangement in accordance with claim 1, wherein the actuating member (40) has a push rod (41) displaceably seated in the lock housing (20), the push rod (41) has an actuating shoulder (44) projecting in a direction of the secondary lock (21), and the actuating shoulder (44) has a control cam (43) on which the control member (24) of the secondary lock (21) runs up when the actuating member (40) is operated.

14. In the locking arrangement in accordance with claim 1, wherein the lock (30) has a control member in loose engagement with an actuating shoulder (42) of the actuating member (40) for operating the bolt (15).

* * * * *